US007818951B1

(12) United States Patent
Boutilier

(10) Patent No.: US 7,818,951 B1
(45) Date of Patent: Oct. 26, 2010

(54) APPARATUS FOR ISOLATION OF RACEHORSE RUNNING MOTION FROM A SULKY CART

(76) Inventor: Malcolm Gaylord Boutilier, P.O. Box 301, Jay, ME (US) 04239

( * ) Notice: Subject to any disclaimer, the term of this patent is extended or adjusted under 35 U.S.C. 154(b) by 0 days.

(21) Appl. No.: 12/533,114

(22) Filed: Jul. 31, 2009

(51) Int. Cl.
*B68B 1/00* (2006.01)
*B68B 5/06* (2006.01)

(52) U.S. Cl. ..... 54/2; 54/69

(58) Field of Classification Search ..... 54/2, 54/50, 52, 56, 69
See application file for complete search history.

(56) References Cited

U.S. PATENT DOCUMENTS

| | | | | | |
|---|---|---|---|---|---|
| 872,347 | A * | 12/1907 | Howell | 54/71 |
| 1,463,175 | A * | 7/1923 | Rasmussen | 119/799 |
| 3,765,151 | A * | 10/1973 | Hall | 54/71 |
| 3,907,325 | A * | 9/1975 | Gaines et al. | 280/657 |
| 4,078,829 | A * | 3/1978 | Davis | 280/657 |
| 4,392,663 | A * | 7/1983 | Forslund | 280/68 |
| 4,662,157 | A * | 5/1987 | Frigon et al. | 54/2 |
| 4,879,866 | A * | 11/1989 | Millington | 54/71 |
| 4,986,059 | A | 1/1991 | Boutilier | |
| 5,056,301 | A | 10/1991 | Garland et al. | |
| 5,183,279 | A * | 2/1993 | Acerno et al. | 280/63 |
| 6,488,291 | B1 * | 12/2002 | Bellis, Jr. | 280/32.7 |
| 7,487,980 | B2 * | 2/2009 | Goddard et al. | 280/63 |
| 2006/0091630 | A1 * | 5/2006 | Goddard et al. | 280/63 |
| 2006/0101791 | A1 * | 5/2006 | Goddard et al. | 54/69 |

* cited by examiner

*Primary Examiner*—Son T. Nguyen
(74) *Attorney, Agent, or Firm*—Dennis R. Haszko

(57) ABSTRACT

An apparatus for the attachment of a racehorse to a racing sulky. The apparatus connects the shafts of the sulky to a harness in a manner so as to isolate racehorse motion from the racing sulky. The apparatus includes a ball joint for rotating attachment to the harness and a threaded end for fixed attachment to the sulky shaft. A dampening piston is provided between the ball joint and the sulky shaft to provide shock absorption and thereby isolate horse movement by dampening the running, trotting, pacing, and galloping motions of the horse from the sulky and vice-versa.

20 Claims, 4 Drawing Sheets

APPARATUS FOR ISOLATION OF RACEHORSE RUNNING MOTION FROM A SULKY CART

FIELD OF THE INVENTION

The present invention relates generally to attachment of a racehorse to a racing sulky. More particularly, the present invention relates to an apparatus for connecting the shafts of a cart or the like to a harness, and even more particularly for attaching the shafts of a racing sulky to a harness in a manner which isolates racehorse motion from the racing sulky.

BACKGROUND OF THE INVENTION

In the field of harness racing, a race horse pulls a two-wheeled cart, or sulky, having a pair of shafts which are attached to a harness saddle circling the horse's body. A breast strap extending across the horse's chest and attached to the saddle or to the shafts by traces may also be used. As the horse runs, it rolls from side to side, i.e., its weight shifts from side to side. This motion is transmitted to the sulky, tending to cause the sulky to fish-tail, or zig-zag, on the track, and to waste the horse's energy. Any side to side motion transmitted to the sulky thus detracts from the forward motion and related momentum of the horse.

Typically, a thimble over the end of each shaft and attached by a strap to the harness may be used to transmit the horse's motion to the sulky. A safety strap attached to the saddle and wrapped around the shaft is often used to ensure that the shafts do not become disconnected from the saddle. Both of these latter devices also contribute to the fish-tailing effect.

It is also desirable to reduce or eliminate skidding of the sulky on the tracks, which tends to occur when making a turn or changing lanes. The three connections referred to above create a barrier to the ability of the horse and sulky to negotiate a turn. This is due to all the force being directed in a straight line. Thus, the horse upon entering a turn at a high rate of speed tends to be forced ahead and toward the outside, and, at the same time, into a more level position even though the turn is banked. This contributes to the loss of distance, time, and racing position.

Attempts have been made to overcome the above-noted disadvantages of the conventional systems for hitching a horse to a sulky by using various ball-joint arrangements. U.S. Pat. No. 4,662,157, for example, discloses a coupling assembly for securing the shafts of a sulky to a saddle wherein a pair of coupling frames are secured to a saddle and are connected to the shafts through a coupling block having a ball-and-socket permitting rotational movement of the shaft relative to the saddle. Each coupling block is secured to a coupling frame by a coupling pin and cotter pin. U.S. Pat. No. 4,326,367 also discloses the use of a pair of ball joints in a device for joining the shafts of a sulky to the harness of a horse. U.S. Pat. No. 4,473,991 discloses a harness connector device wherein a pin secured to the harness fits into a first ball joint connected through a linking member to a second ball joint, which in turn is connected to a shaft.

U.S. Pat. No. 4,072,000 discloses a so-called "single-hitch" sulky utilizing a yoke which overlies and is attached to the saddle of a horse harness. In practice, such a yoke has been connected to the sulky shafts by longitudinally adjustable sleeves, the posterior ends of which fit over the front ends of the sulky shafts. Such sleeves may be adjustably fitted over the sulky shaft to vary the distance from this connection to the cart. This type of hitch, however, can cause instability, in that the sulky has a tendency to tip over.

U.S. Pat. No. 4,986,059 issued to Boutilier discloses a device for connecting a sulky shaft to a harness. A harness pin assembly is fixedly mounted on a harness saddle and the harness pin projects outwardly from the saddle at an angle of approximately 90 degrees. A releasable locking device on the harness pin is positioned intermediate the saddle and the outer end of the pin. A connector assembly, for releasably connecting the harness pin assembly to the shaft, comprises a housing member which can be secured to the shaft by straps or the like. The housing member is provided with a ball-retaining aperture, and a ball member is rotatably secured in the ball-retaining aperture and is provided with a cylindrical aperture through the center thereof, the aperture having a diameter adapted to receive the harness pin. A collar member extends from opposite sides of the ball member so as to limit the rotation of the ball member in the housing. The locking device is adapted to permit the harness pin to be inserted into the cylindrical aperture past the locking device when the locking device is in an unlocked position and then lock the ball member on the harness pin when the harness pin is in a normally locked position.

U.S. Pat. No. 5,056,301 issued to Garland & Boutilier discloses a sulky cart that leaves shafts with off-set forward end portions. The sulky cart is releasably attached to an off-set elongated sleeve member with a connector assembly on the forward end of the sleeve member. The connector assembly contains a rotatable ball with a central aperture for sliding over a harness pin secured to and extending from a harness saddle. The harness pin is provided near its outer end with a normally locked locking device, so that the cart can be hitched to the saddle harness by sliding the harness pin and locking device through the central aperture in the ball.

Use of the above Boutilier and the Garland & Boutilier devices permit vastly improved times and performances, and previously difficult to handle horses have been observed to race more evenly when such devices are used.

However, such previous devices presently in use can cause the horse to be pushed to the outside of the turn through centrifugal force and the skidding motion of the sulky. It should be noted that turns are entered by race horses at speeds up to 35 miles per hour. The inside shaft of the currently used devices which are solidly affixed to the sulky arch, pushes forcefully against the side of the racehorse and causes the horse to lean into the shaft in order to negotiate the turn. This loses time for the horse and fatigues it as well thus causing lameness due to the stress on the knees, ankle, hocks, fetlocks and pasterns.

It has now been determined by tests on the track that the present invention provides still further improvements in sulky and harness design and performance, and use of the present invention enables the driver to have still further improved control and feel during a race.

SUMMARY OF THE INVENTION

It is an object of the present invention to obviate or mitigate at least one disadvantage of previous harness/sulky connections. Advantages of the present invention will become apparent from the following description and accompanying drawings of a preferred embodiment thereof and from the manufacture and use of the invention.

In a first aspect, the present invention provides an apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus including: a dampening piston having a first end and a second end, the first end being movably attached to the second end; the first end of the dampening piston having a ball joint connected to a rod, the ball joint mounted within a socket for rotational movement and having a central aperture for receiving the pin; and the second end of the dampening piston including a threaded connector for affixing the dampening piston to the sulky shaft.

In a further embodiment, there is provided an apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus including: a dampening piston including a first end having a ball joint connected to a rod, the ball joint mounted within a socket for rotational movement and having a central aperture for receiving the pin, and a second end having a threaded connector for affixing the dampening piston to the sulky shaft, the first end being movably attached to the second end via an inner portion and an outer portion of the dampening piston, the inner portion connected to the rod and the outer portion connected to the threaded connector, the inner and outer portions configured to move along a lengthwise axis of the apparatus in shock absorbing counteraction of forces transferred through the apparatus between the sulky and the horse.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached figures.

DETAILED DESCRIPTION

Generally, the present invention provides a connecting device that serves to isolate the running motions of a racehorse from a sulky cart. The connecting device isolates horse movement by dampening the running, trotting, pacing, and galloping motions of the horse from the two wheeled racing cart (i.e., sulky) which is pulled by the horse. With reference to the figures along with reference to U.S. Pat. No. 5,056,301 issued Oct. 14, 1991 to Garland and Boutilier and, herein incorporated by reference in its entirety, the present invention is a new and useful improvement for attaching the sulky to a harness.

Figure 1B:
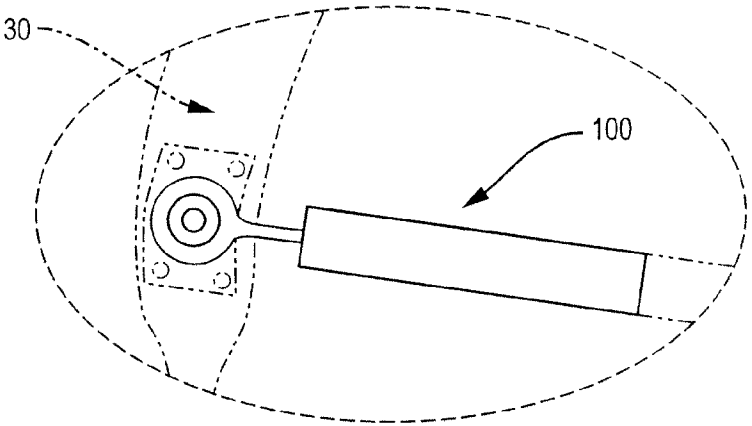
FIG. 1B is a close-up illustration of area 1B from FIG. 1A and showing the apparatus of the present invention in conjunction with a harness.
Figure 1A:
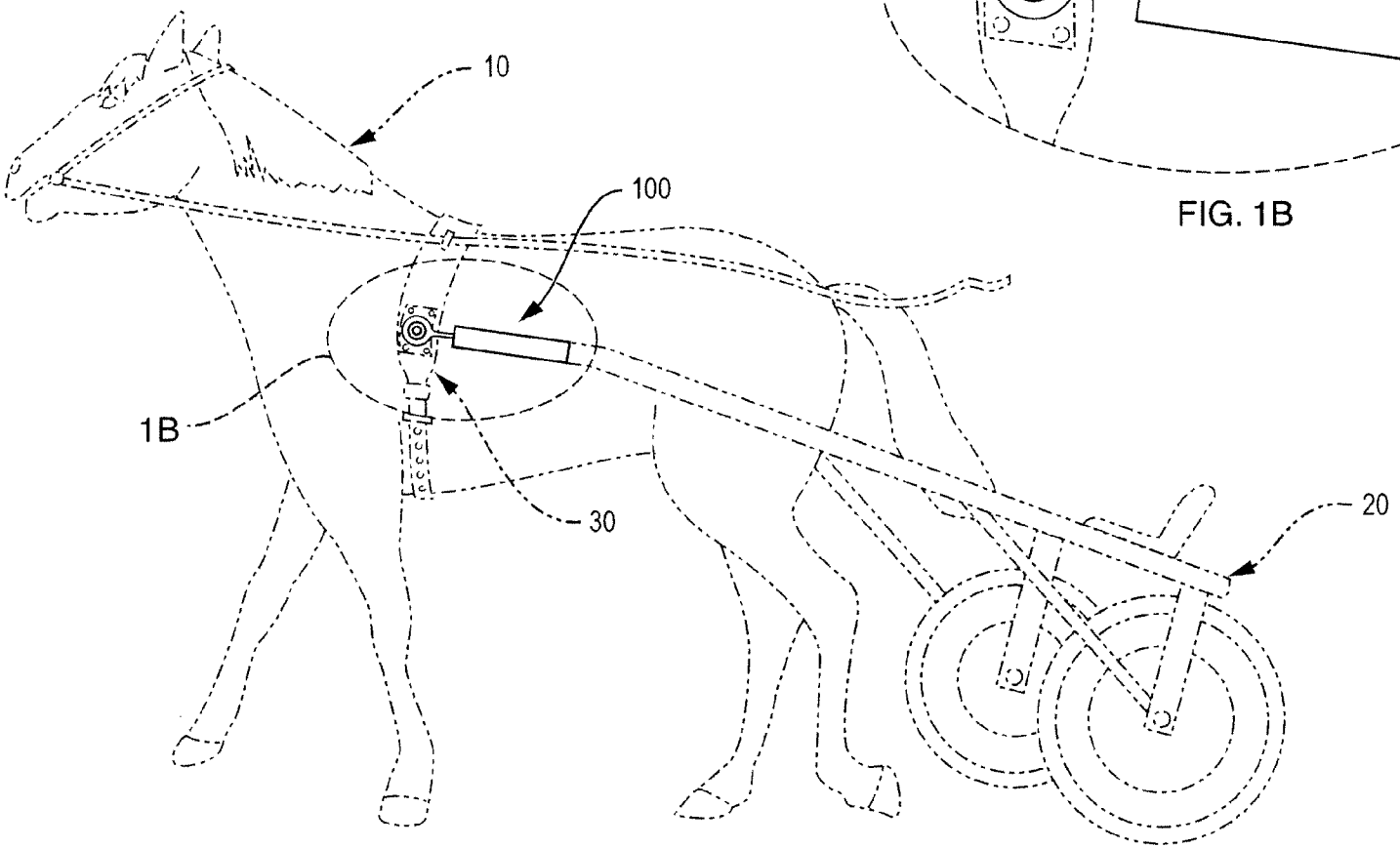
FIG. 1A is an illustration of a racing sulky and horse (seen by dotted line) showing the attachment of the shafts of the sulky to the harness saddle on the horse in accordance with the present invention (seen in solid line).
Figure 2:
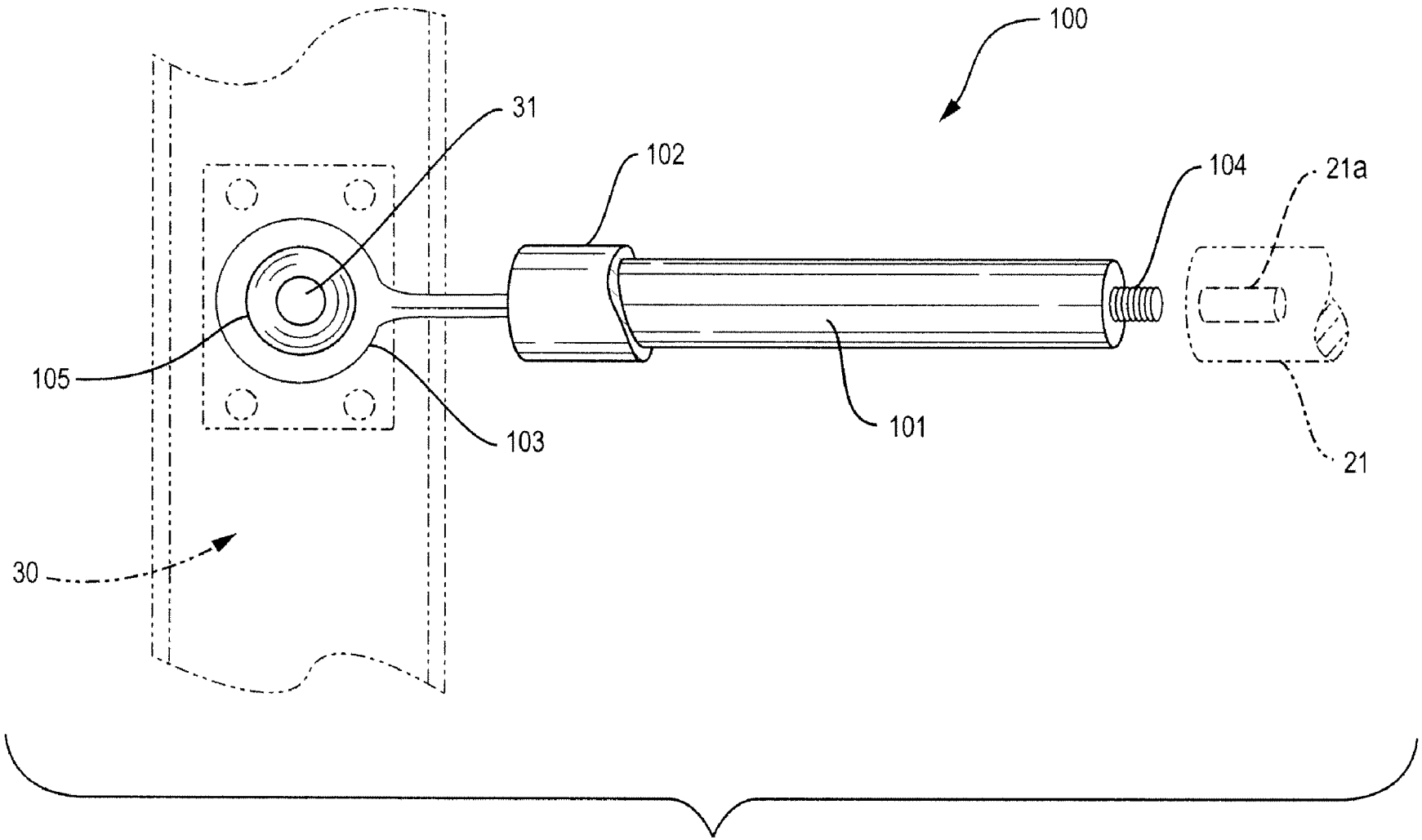
FIG. 2 is a partial-cutaway view of the illustration from FIG. 1B showing the apparatus of the present invention in connection with the harness and in detached relation to the shaft.

With regard to FIGS. 1A, 1B, and 2 the present invention provides a connecting device 100 for connecting a sulky 20 to a harness 30. The two-wheeled racing sulky 20 has attached to it a pair of long shafts 21 extending forwardly toward a horse 10 which pulls the sulky 20. The shafts 21 are laterally spaced from each other, one on either side of the horse 10. A circumferential harness saddle 30 is secured on the horse 10 typically via a girth strap which is cinched around the barrel of the horse 10 behind its front legs. In hitching the horse to the sulky, each shaft 21 is secured to the saddle 30 by the device 100 of the present invention, which is hereinafter described.

It will be understood that, in hitching the horse 10 to the sulky 20, two identical connecting devices 100 are employed. Each is mounted on the saddle 30 on either side of the horse 10 and attaches to one of the shafts 21. For simplicity of illustration, however, only one connecting device 100 will be described in connection with one sulky shaft 21. As shown in the figures and best seen in cross-section by way of FIG. 4, each of the connecting devices 100 attaches to a harness pin 31 firmly secured to the saddle 30, preferably above the midline of the horse's side.

The saddle 30 usually is made of sturdy leather formed in a known manner with an outer strap and an inner strap with a formed plastic cushion between the straps. As discussed in U.S. Pat. No. 5,056,301, the harness pin 31 is fastened to the saddle 30 with suitable bolts, although rivets or the like may be used. Details of the harness pin 31 are beyond the scope of the claimed invention, but are integral to the use of the present invention and are thus described herein so as to provide proper enablement to practice the present invention. The mounting means for the harness pin 31 includes a first metal mounting plate provided with suitable through holes for insertion of the bolts used to secure the mounting plate to the saddle 30. The harness pin 31 is made from a strong corrosion resistant metal, such as a stainless steel, is secured to the mounting plate. The inner end of the elongated, cylindrical harness pin 31 is affixed to the mounting plate, for example, by welding, and the pin 31 projects outwardly from the mounting plate at an angle of approximately 90 degrees. In affixing the harness pin assembly to the saddle 30, it is advantageous to position the mounting plate on the inner side of the strap, i.e., the side toward the horse, and to place a second mounting plate opposite the first plate on the outside of the saddle for added rigidity. The fastening bolts and harness pin 31 pass through appropriate holes punched in the outer strap and the harness pin assembly is thereby secured to the saddle 30.

Figure 3:
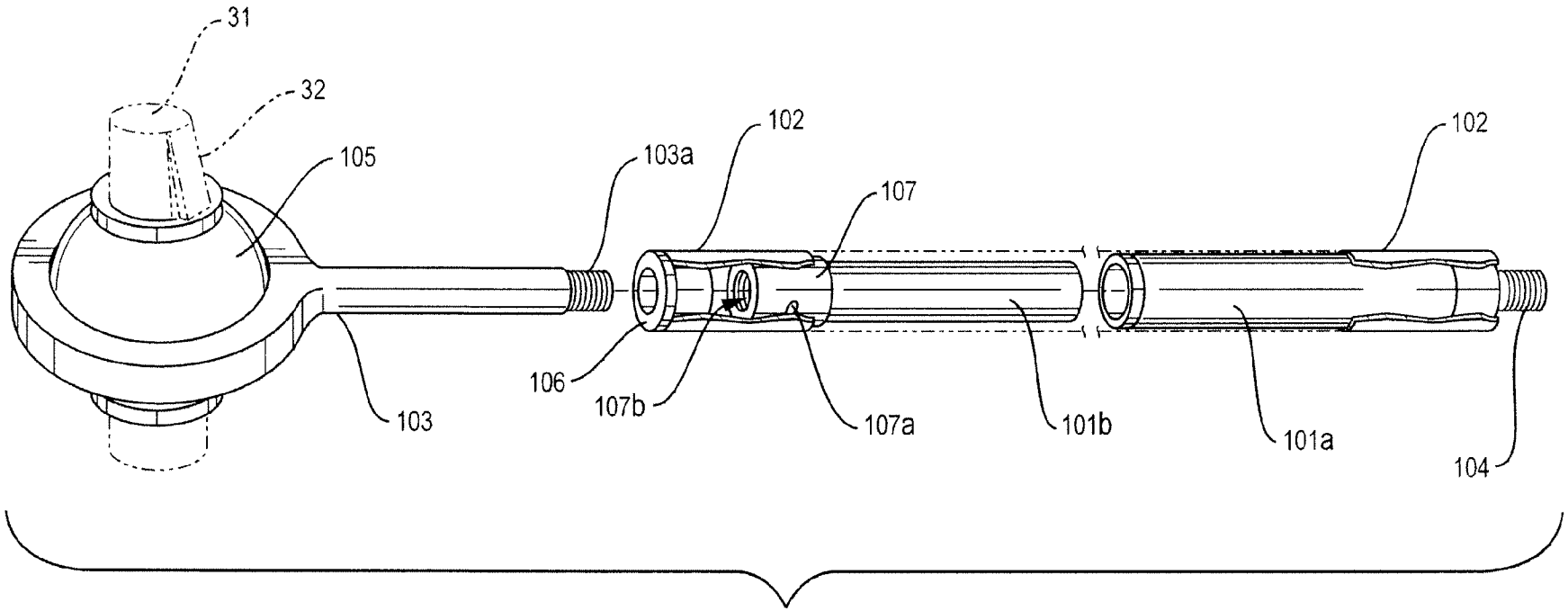
FIG. 3 is an exploded view of the apparatus of the present invention with a portion of the housing removed.

Each of the connecting devices 100 includes a forward portion extending toward the horse's head and an adjoining rear portion extending toward the sulky. Attached to the forward portion there is a ball joint 105 for attaching the connecting device 100 to the harness pin 31 on the saddle 30. As best seen in FIG. 3, each ball joint 105 is formed of steel or other suitable metal and is provided with a ball-retaining aperture at the end of rod 103. The ball joint 105 is rotatably held in the circular bore so as to be free to swivel, or rotate, therein in all directions. Preferably, the inner bore surface is provided with friction-reducing seating material, such as polytetrafluoroethylene or another suitable resin, to facilitate the rotation of the ball joint 105. Preferably, the bore holding the ball joint 105 is stepped on both sides to permit the desired degree of rotation of the ball joint 105 yet suitable for retaining the ball joint 105 in the aperture. The ball member joint 105 is a rounded steel ball provided with a central cylindrical aperture passing through the ball joint 105 and a circular lip, or collar, on each side surrounding the periphery of the central cylindrical aperture through which the harness pin 31 may pass. This type of swiveling ball joint is known in the machine art as a "high misalignment" ball joint. Such a "high misalignment" ball joint provides a significant advantage over a ball joint using a fully rounded ball.

The configuration of the harness pin 31 provides that the diameter of the central cylindrical aperture through which the harness pin 31 passes has a close tolerance, for example, a 0.002" tolerance in relationship to the diameter of the harness pin 31. This close tolerance allows for precise transfer of forces and thus accurate steering for the harness racing driver and a more intimate sense of "feel" and control when negotiating in close quarters in racing situations. In short, this close tolerance, coupled with the ability of the ball joint to rotate relative to the shaft provides the desired precision in driver control over the horse.

To facilitate inserting the harness pin 31 into the ball joint 105, the outer end of the harness pin 31 is provided with a slight taper. The pin locking device 32 is preferably of the positive locking type. That is, after the harness pin 31 is fully inserted into the ball joint 105, the ball joint 105 cannot be removed from the harness pin 31 except by positively releasing the locking device 32. Further, the locking device 32 is of the type which is normally in the locked position and a positive action, e.g., a manual action, is required to unlock it so as to permit the ball joint 105 to be removed from the harness pin 31 by sliding the ball joint 105 over the outer end of the harness pin 31. When manually depressed and retracted against the harness pin 31, the ball joint 105 can be slid over and off of the harness pin 31 to quickly release the sulky shaft 21 from the harness 30. This type of attachment is of great importance to horsemen who frequently use the same sulky in multiple races on a given racing program and have to make a rapid detachment of a sulky from the harness on one horse and equally rapid attachment of the same sulky to the harness on another horse.

Figure 4:
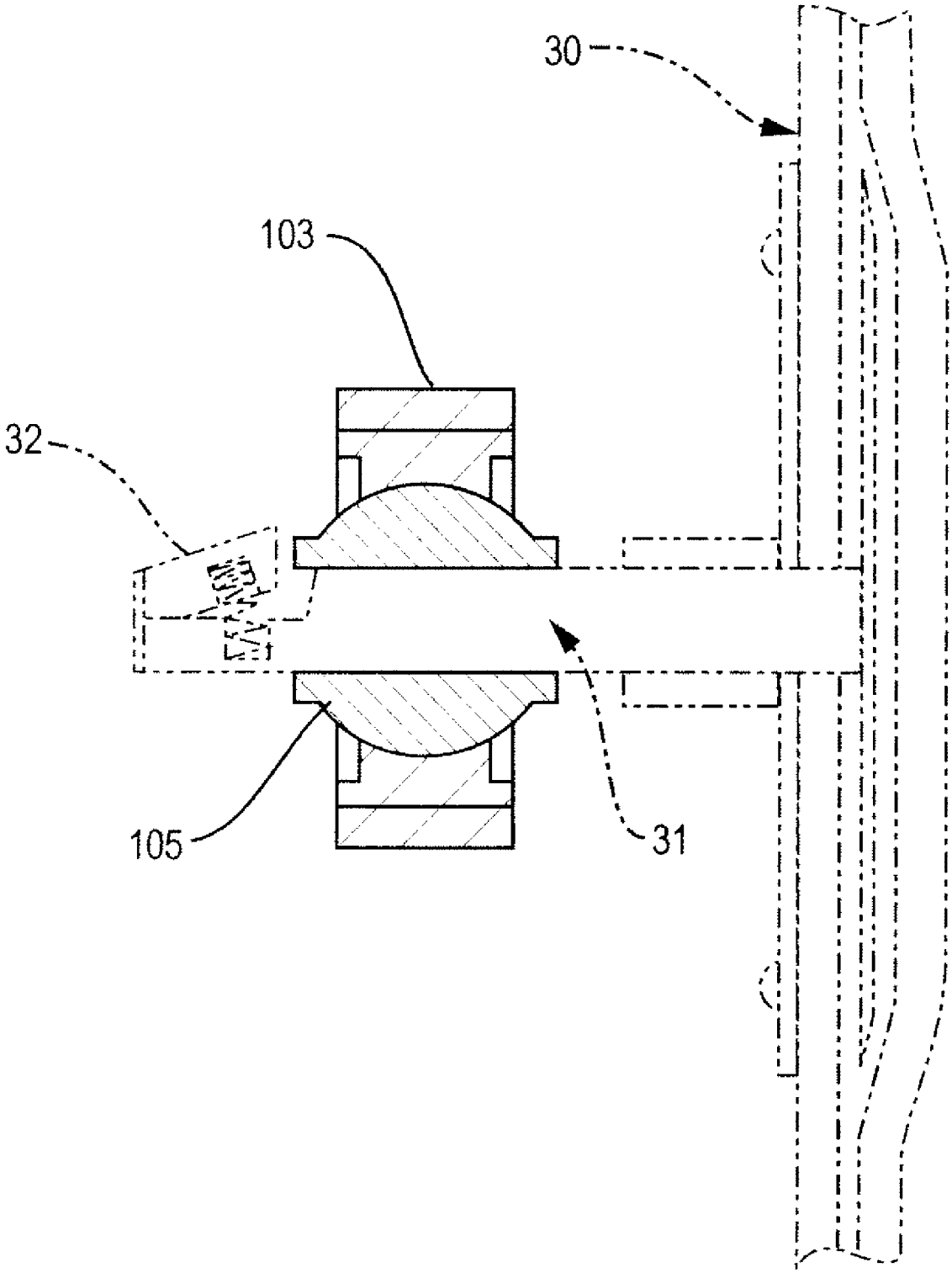
FIG. 4 is a cross-sectional view of the apparatus of the present invention as connected to a known harness saddle post.

An advantage of the locking device 32 shown in FIGS. 3 and 4 is that it retracts easily when the ball joint 105 is slid onto a harness pin 31 when hitching the sulky 20. However, once the harness pin 31 and locking device 32 are slid through the ball joint 105, the locking device 32 shown locks tighter as pressure is applied against it. The harness pin 31 extends outwardly approximately ⅜" beyond the locking ends, and this end of the harness pin 31 is tapered to permit easy starting into the central aperture of the ball joint 105 when hitching the sulky 20.

There is no extra action required to put the connecting device 100 on the harness pin 31 other than slipping it over the harness pin 31, and the lock automatically retracts while the ball joint 105 goes on the harness pin 31. To hitch the sulky 20, the shafts 21 are brought into position on either side of the horse 10, the ball joint 105 is centered over harness pin 31 and pushed into place, first one side and then the other. To remove the sulky 20, the spring loaded locking device 32 is pushed in, even with the pin's periphery. Then, the ball joint 105 is pulled off the harness pin 30. This action on both sides removes the sulky 20 from the harness 30. It should be understood that the height and angle of the harness pin 31 as it protrudes from the harness 30 should be configured so that the ball joint 105 is able to slide freely along the harness pin 31. This requires that the harness pin 31 be mounted at an angle of substantially 90 degrees to the base plate of the harness 30 as is clearly shown in FIG. 4. Any substantial deviation of this angle of the harness pin 31 in relation to the base plate may produce binding of the ball joint's movement along the harness pin 31, thus reducing the utility of the device 100.

Having thus discussed the connecting device 100 with specific detail to the high misalignment ball joint, the present invention shall now be discussed in terms of the inventive dampening aspects. As illustrated in FIG. 1A, a sulky 20 is attached behind the horse 10. The driver (not shown) sits upon the sulky seat. As the horse 10 pulls the sulky 20, the motion of the horse's body causes the sulky 20 to move in a variety of ways including, but not limited to, weaving, wiggling, zigzagging, wobbling, and bobbling. These motions are transmitted from the horse 10 to the sulky 20 and to the driver sitting on the sulky seat. In turn, these motions may be retransmitted back to the horse 10 via rocking or jittering of the sulky 20. This is due in large part to the weight of the displaced, moved, or otherwise shaken driver being transmitted back to the horse 10 through the sulky shafts which are attached to the horse's harness 30.

Generally speaking, such various motions are counter, or at a minimum counterproductive to, the forward movement of the horse and sulky assembly. The various motions placed upon the horse also form a continuous rocking/rolling/side-to-side motion which adds additional exertion to the horse and thus causes fatigue and lameness. Since ancient Roman times, this has been a problem for all two-wheeled carts pulled behind a horse. In North America, Europe, New Zealand and Australia, there are an estimated 100,000 of these racing sulkies. None of them can travel in a true straight line. Indeed, such travel outside of a straight line oftentimes causes momentary plowing which will reduce overall sulky performance. The present invention provides a solution to this age old problem.

With regard to FIGS. 1A, 1B, and 2, the present invention is further described. To isolate the motion of the horse 10 from that of the sulky 20, the present invention provides an apparatus 100 at the end of each shaft 21 which extends from the transverse arch of the sulky 20 to the harness 30. The apparatus is designed and sized to be a seamless extension of the shaft 21. The apparatus 100 can be sized to be approximately six inches long and provides up to one and one half inches of dampening movement via a rod 103 extending from the dampening piston 101 to the base of a ball joint connector 105. As seen in FIG. 3, the ball joint connector 105 is attachable to a known type of harness post 31 and fixed thereto via a retention clip 32. The end of the dampening piston includes a male threaded end 104 designed to be secured in a removable manner within a corresponding threaded socket 21*a* within the tip of the sulky shaft 21. In this manner, the apparatus 100 affixes the each sulky shaft 21 to the harness 30.

FIG. 2 also shows a partially cut-away section of housing 102. The housing as shown covers the exposed end of the rod 103 connecting to the dampening piston 101. The housing 102 may be thin aluminum sheathing or any other suitable cylindrical casing of a hard and durable material which is designed with an open end closest to the harness 30 to allow axial movement of the rod 103. When the apparatus 100 is firmly attached to the shaft 21 by way of threaded end 104, the outer diameter of the housing 102 and the outer diameter of the shaft 21 are smooth transitions such that the apparatus 100 is in flush abutment with the shaft 21.

Such details are further visible by way of the exploded view illustrated in FIG. 3. Here, the housing 102 can be seen covering the constituent inner 101*b* and outer 101*a* portions of the dampening piston 101. Typically the housing 102 is a sleeve formed of high tensile strength tubing, for example, aircraft steel tubing made of S.A.E. 4130 Cr—Mo steel. The inner portion 101*b* includes a rod attachment tip 107 having a female threaded tip 107*b* which may be formed integrally with the inner portion 101*b* or may be attached by suitable manner such as being welded or screwed together. The rod attachment tip 107 also includes a pilot hole 107*a* which can be used to immobilize the inner portion 101*b* from rotational movement such that the threaded end 103*a* of the rod 103 can be manually screwed into place within the female threaded tip 107*b*. The pilot hole 107*a* would have a corresponding hole (not shown) within the housing 102 to allow passage of a key (or suitable metal device such as a screwdriver tip) to lock the rod attachment tip 107 and connected inner portion 101*b* in place thus preventing rotation while the rod 103 is rotated within end plug 106 affixed to the end of the housing 102.

With further regard to FIG. 3, it should be understood that the dampening piston 101 may be alternatively designed in any suitable shock absorbing manner and that such a variety of dampening designs may be possible without straying from the intended scope of the present invention. The dampening piston 101 serves to absorb shocks transmitted from the harness 30 or from the shaft 21 and can be formed from any shock absorbing mechanism such as, but not limited to, pneumatic, hydraulic, gas, nitrogen, air, or a proper combination of springs as long as it absorbs the continuous impact of the horses motion arising from the attachment of the harness to the sulky shafts. The dampening piston 101 counters the aforementioned variety of extraneous motions engendered by every sulky cart and harness combination presently used worldwide in sulky racing. The present invention thus enables a horse and sulky using the invention to more easily negotiate turns on a race track.

As should be readily apparent, each shaft 21 (of which there are of course two per sulky 20) includes an apparatus 100 affixed thereto. During horse and sulky operation, the inventive apparatus 100 allows independent movement of each dampening piston 101 and corresponding rod 103 in a smooth, dampened fashion. Moreover, the connection on one shaft may at any given moment extend up to one and one half inches in concert with the connection on the opposite shaft. Such concerted movement between shafts is most evident upon rounding turns along the race track. The present invention thus benefits the horse, driver, and other drivers in the race by allowing the horse and sulky combination using this apparatus to smoothly, and with greatly reduced pressure, safely enter and exit the turns without skidding and possibly hitting adjacent horses.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus comprising:

a dampening piston having a first end and a second end, the first end being movably attached to the second end;

the first end of the dampening piston having a ball joint connected to a rod, the ball joint mounted within a socket for rotational movement and having a central aperture for receiving the pin; and the second end of the dampening piston including a threaded connector for affixing the dampening piston to the sulky shaft.

2. The apparatus as claimed in claim 1, wherein the dampening piston includes an inner portion connected to the rod and an outer portion connected to the threaded connector, the inner and outer portions configured to reciprocatingly move along a lengthwise axis of the apparatus in response to forces transferred through the apparatus between the sulky and the horse.

3. The apparatus as claimed in claim 2, wherein a rod attachment tip is affixed to the inner portion, the rod attachment tip including inner threads configured to accept outer threads located on the rod.

4. The apparatus as claimed in claim 3, wherein the rod attachment tip includes a pilot hole for preventing rotation of the inner portion along the lengthwise axis of the apparatus relative to the outer portion upon insertion of a metal device into the pilot hole.

5. The apparatus as claimed in claim 4, wherein both the inner portion and the outer portion of the dampening piston are encapsulated completely within a housing, the housing being immovably affixed to the outer portion of the dampening piston, and the inner portion being freely movable within the housing.

6. The apparatus as claimed in claim 5, wherein the housing includes an opening through which the rod is capable of freely passing.

7. The apparatus as claimed in claim 6, wherein the housing includes a keyhole configured to be aligned with the pilot hole in a manner so as to prevent rotation of the inner portion upon insertion of the metal device through the keyhole and into the pilot hole.

8. An apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus comprising:

a dampening piston including a first end having a ball joint connected to a rod, the ball joint mounted within a socket for rotational movement and having a central aperture for receiving the pin, and a second end having a threaded connector for affixing the dampening piston to the sulky shaft, the first end being movably attached to the second end via an inner portion and an outer portion of the dampening piston, the inner portion connected to the rod and the outer portion connected to the threaded connector, the inner and outer portions configured to move along a lengthwise axis of the apparatus in shock absorbing counteraction of forces transferred through the apparatus between the sulky and the horse.

9. The apparatus as claimed in claim 8, wherein a rod attachment tip is affixed to the inner portion, the rod attachment tip including threads configured to accept mating threads located on the rod.

10. The apparatus as claimed in claim 9, wherein both the inner portion and the outer portion of the dampening piston are encapsulated completely within a housing, the housing including an opening through which the rod is capable of freely passing, the housing being immovably affixed to the outer portion of the dampening piston, the inner portion being freely movable within the housing, the rod attachment tip including a pilot hole, and the housing including a keyhole configured to be aligned with the pilot hole in a manner so as to prevent rotation of the inner portion upon insertion of a metal device through the keyhole and into the pilot hole.

11. The apparatus as claimed in claim 10, wherein the dampening piston is a shock absorbing mechanism of a type selected from the group consisting of pneumatic, hydraulic, gas, nitrogen, air, and spring.

12. The apparatus as claimed in claim 11, wherein the housing is formed of a thin metal tube having an outer diameter identical to an outer diameter of the shaft.

13. The apparatus as claimed in claim 11, wherein the housing is formed of a thin metal.

14. The apparatus as claimed in claim 13, wherein the housing includes a cross-section identical to a cross-section of the shaft.

15. An apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus comprising:

a dampening piston including a first end having a ball joint connected to a rod, the ball joint mounted within a socket for rotational movement and having a central aperture for receiving the pin, and a second end having a threaded connector for affixing the dampening piston to the sulky shaft, the first end being movably attached to the second end via an inner portion and an outer portion of the dampening piston, the inner portion connected to the rod and the outer portion connected to the threaded connector, the inner and outer portions being in alignment with the sulky shaft, and configured to reciprocatingly move along a lengthwise axis of the apparatus in response to forces transferred through the apparatus between the sulky and the horse.

16. The apparatus as claimed in claim 15, wherein the dampening piston is positioned at a forward end of the sulky shaft.

17. The apparatus as claimed in claim 16, wherein both the inner portion and the outer portion of the dampening piston are encapsulated completely within a housing, the housing being immovably affixed to the outer portion of the dampening piston, and the inner portion being freely movable within the housing.

18. The apparatus as claimed in claim 17, wherein a rod attachment tip is affixed to the inner portion, the rod attachment tip including inner threads configured to accept outer threads located on the rod.

19. The apparatus as claimed in claim 18, wherein the housing includes an opening through which the rod is capable of freely passing.

20. An apparatus for isolating forces between a horse and a sulky, the apparatus connecting a sulky shaft to a horse harness having a base plate mounted on the horse harness, a pin projecting substantially perpendicularly outwardly from the base plate, and a locking device carried by the outer end of the pin to removably secure the pin to the apparatus thereby facilitating attachment of the sulky to the horse and preventing accidental detachment therefrom, the apparatus comprising:

a dampening piston including a first end having a ball joint connected to a rod, the ball joint mounted within a socket for rotational movement and having a central aperture for receiving the pin, and a second end having a threaded connector for affixing the dampening piston to the sulky shaft, the first end being movably attached to the second end via an inner portion and an outer portion of the dampening piston, the inner portion connected to the rod by a rod attachment tip affixed to the inner portion, the rod attachment tip including inner threads configured to accept outer threads located on the rod, and the outer portion connected to the threaded connector, the inner and outer portions positioned at a forward end of the sulky shaft, configured to be in alignment with the sulky shaft, and configured to reciprocatingly move along a lengthwise axis of the apparatus in response to forces transferred through the apparatus between the sulky and the horse, the inner portion and the outer portion being encapsulated completely within a housing, the housing including an opening through which the rod is capable of freely passing, and being immovably affixed to the outer portion of the dampening piston, and the inner portion being freely movable within the housing.

* * * * *